US008419379B2

(12) United States Patent
Bass et al.

(10) Patent No.: US 8,419,379 B2
(45) Date of Patent: Apr. 16, 2013

(54) TOOL CASE FOR AN AIR COMPRESSOR

(75) Inventors: Gary S. Bass, Independence, KY (US); Christopher D. Klein, Cincinnati, OH (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 1478 days.

(21) Appl. No.: 11/684,192

(22) Filed: Mar. 9, 2007

(65) Prior Publication Data

US 2007/0217924 A1 Sep. 20, 2007

Related U.S. Application Data

(60) Provisional application No. 60/782,024, filed on Mar. 14, 2006.

(51) Int. Cl.
*F04B 53/00* (2006.01)
*F04B 39/00* (2006.01)
*E03B 5/00* (2006.01)

(52) U.S. Cl.
USPC ..... 417/234; 417/572; 137/565.18

(58) Field of Classification Search ..... 417/234, 417/572; 137/565.18, 899.4; 220/23.6, 694, 220/729
See application file for complete search history.

(56) References Cited

U.S. PATENT DOCUMENTS

| | | | | | |
|---|---|---|---|---|---|
| 1,538,754 | A * | 5/1925 | Spohrer | ..... | 137/565.18 |
| 2,328,669 | A * | 9/1943 | Nicholson | ..... | 220/694 |
| 5,318,787 | A * | 6/1994 | Brauner et al. | ..... | 426/120 |
| 5,743,423 | A * | 4/1998 | Franco | ..... | 220/23.86 |
| 6,736,415 | B1 * | 5/2004 | Lenihan | ..... | 280/47.19 |
| 2002/0044871 | A1 * | 4/2002 | Montgomery | ..... | 417/201 |
| 2002/0148066 | A1 | 10/2002 | Bullis | | |
| 2005/0196290 | A1 | 9/2005 | Hu | | |
| 2006/0104837 | A1 * | 5/2006 | Lee et al. | ..... | 417/415 |

* cited by examiner

*Primary Examiner* — Devon Kramer
*Assistant Examiner* — Bryan Lettman
(74) *Attorney, Agent, or Firm* — Jones Day

(57) ABSTRACT

An apparatus includes a compressor. The compressor has an air pump and a tank configured to store air compressed by the air pump. The compressor is configured to be used while in an operating position in which the tank is in an upright position. In the upright position, the tank has a vertical cylindrical side surface and a rounded top surface. A storage case is configured to be removably mounted on top of the tank in a mounted position in which the case engages both the top surface and the side surface of the tank at different locations selected so as to prevent the case from sliding off the tank when a horizontal force in any horizontal direction is applied to the tank urging the case to slide off the tank.

15 Claims, 2 Drawing Sheets

TOOL CASE FOR AN AIR COMPRESSOR

CROSS-REFERENCE TO RELATED APPLICATION

This application claims the benefit of U.S. Provisional Application No. 60/782,024, filed Mar. 14, 2006, hereby incorporated herein by reference.

TECHNICAL FIELD

This application relates to tool cases and air compressors.

BACKGROUND

A tool case can be used to store pneumatic tools used with a compressor. The compressor includes an air pump and an air tank.

DESCRIPTION

Figure 1:
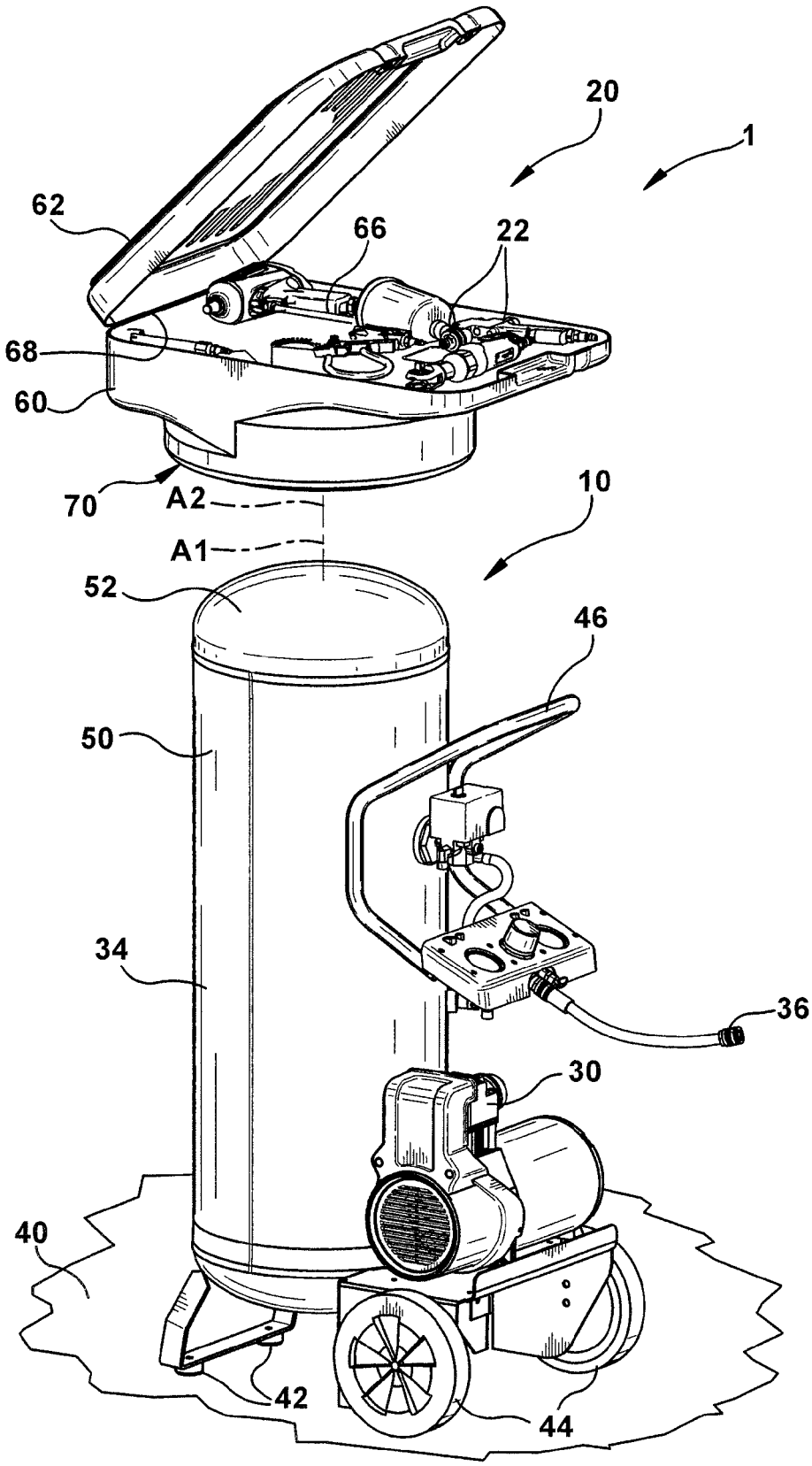
FIG. 1 is a perspective view of a compressor and a tool case.

The apparatus 1 shown in FIG. 1 has parts that are examples of the elements recited in the claims. The apparatus thus includes examples of how a person of ordinary skill in the art can make and use the claimed invention. It is described here to meet the requirements of enablement and best mode without imposing limitations that are not recited in the claims.

The apparatus 1 includes a compressor 10 and a storage case 20. The case 20 in this example is a tool case used to store items that are used with the compressor 10, such as air tools 22 and/or tool accessories.

The compressor includes an air pump 30 and an air tank 34 that stores air compressed by the pump 30. A hose 36 conducts air stored in the tank 34 to air-receiving devices, such as the air tools 22 to be pneumatically powered and tires to be inflated. The compressor 10 is supported on the ground 40 by a foot support, in this example comprising two front feet 42, and rear wheels 44. A handle 46, attached to the tank 34, can be manually grasped to tilt the compressor 10 rearward about its wheels 44. This raises the feet 42 above the ground 40 so that they will not scrape the ground 40 as the compressor 10 is moved. The compressor 10 is then pushed or pulled by its handle 46 to wheel the compressor 10 across the floor 40.

The compressor 10 is configured to be used while in an operational position, as in FIG. 1, in which the feet 42 engage the floor 40 and the tank 34 is in an upright position. With respect to its upright position, the tank 34 has a cylindrical side surface 50 centered on a vertical axis A1. It further has a convex rounded, more specifically semi-oval domed, top surface 52 centered on and symmetric about the axis A1.

The case 20 has a base 60 and a lid 62. The base 60 has securing structures for securing the tools 22 and accessories in place, such as pockets 66 sized and shaped to match particular tools 22 and accessories. The base 60 and the lid 62 are connected together by a hinge 68. The lid 62 can be pivoted about the hinge 68 into a closed position, as in FIG. 2, in which tools 22 are encased in a storage cavity defined by the base 60 and the lid 62. The lid 62 can be latched closed to prevent it from opening. When unlatched, the lid 62 can be pivoted about the hinge 68 into an open position, as in FIG. 1, to expose the tools 22.

Figure 2:
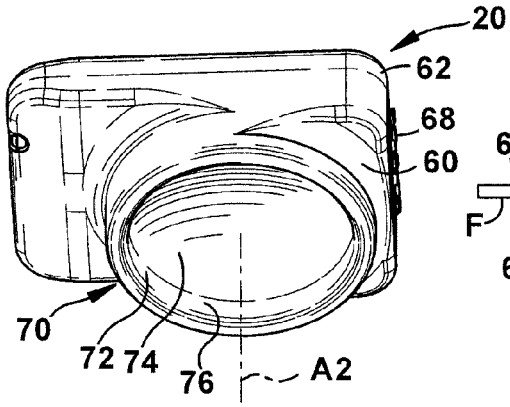
FIG. 2 is a view of the tool case, taken at a different perspective than in FIG. 1.

As shown in FIG. 2, the case 20 has a bottom 70 with a tank-contacting surface 72. This surface 72 has an upper section 74 and a side section 76, both centered on and symmetric about an axis A2. These two sections 74 and 76 respectively have concave and cylindrical contours respectively matching the contours of the top 52 and side surfaces 50 of the tank 34.

Figure 3:
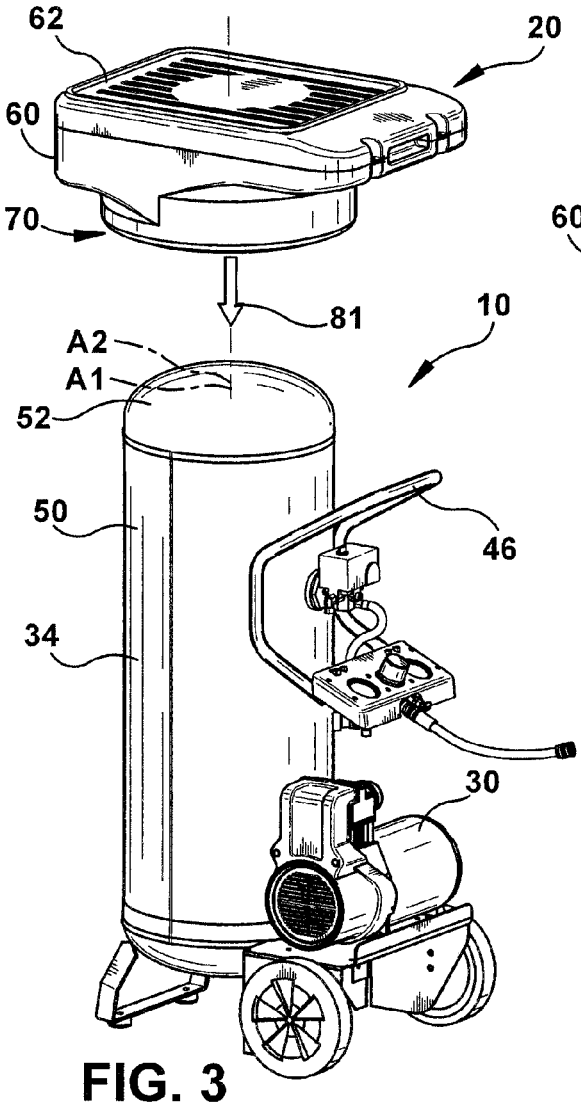
FIG. 3 is a perspective view of the tool case being mounted onto a tank of the compressor.

As indicated by an arrow 81 in FIG. 3, the case 20 can be brought into a mounted position on the tank 34 by positioning the case 20 to align the axes A1 and A2 and then simply lowering the case 20 directly downward onto the tank 34. Conversely, the case 20 can be removed from its mounted position by lifting the case 20 directly upward off of the tank 34.

Figure 5:
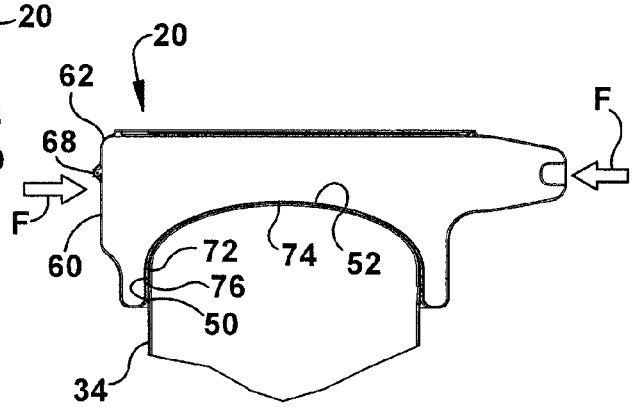
FIGS. 4 and 5 are, respectively, perspective and sectional views of the tool case shown mounted on the tank.
Figure 4:
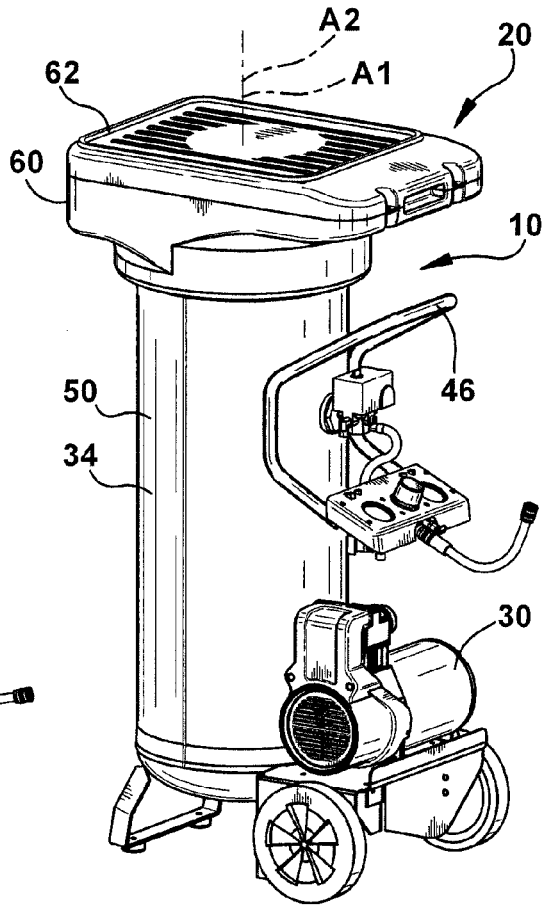

FIGS. 4-5 show the case 20 in its mounted position. The rounded upper section 74 of the case's tank-contacting surface 72 rests on the top surface 52 of the tank 34, and preferably engages the entire top surface 52 of the tank 34. The cylindrical side section 76 of the case's tank-contacting surface 72 engages the tank's cylindrical side surface 50 at different locations about the circumference of the tank 34 selected so as to prevent the case 20 from sliding off the top of the tank 34 when a horizontal force (exemplified by arrows F in FIG. 5), directed in any horizontal direction, is applied to the case 20 urging the case 20 to slide off the tank 34. Therefore, a latch or fastener for securing the case 20 to the tank 34 is unnecessary and absent.

The locations selected to prevent the case 20 from slipping off the tank 34, mentioned above, should include at least one location in each of three contiguous 120-degree circumferential sections that together comprise the tank's circumference. There are multiple configurations that achieve this. For example, the cylindrical section 76 of the case 20 can, as in this example, engage the tank's cylindrical side surface 50 about the full circumference. Alternatively, the case 20 can engage less than the full circumference but over half the circumference, whether in one continuous line of contact or in two or more separated bands of contact. Or the case 20 can engage the tank's cylindrical surface 76 at multiple isolated locations, such as with multiple narrow vertical ribs, as long as the engagement locations include an engagement location in each of three circumferential 120-degree sections comprising the circumference.

A user can buy different cases, including the case 20 described above, to be mounted interchangeably on the tank 34. The cases can have outer shells that are identical or at least have the same outer appearance. Yet they can differ in the type of tools and accessories they carry, and thus differ in their internal configuration such as by differing in their securing structures 66 (FIG. 1).

In summary, in the above example shown in FIGS. 1-5, an apparatus 1 includes a compressor 10. The compressor 10 includes an air pump 30 and a tank 34 configured to store air compressed by the air pump 30. The compressor 10 is configured to be used while in an operating position in which the tank 34 is in an upright position. In the upright position, the tank 34 has a vertical cylindrical side surface 50 and a rounded top surface 52. A storage case 20 is configured to be removably mounted on top of the tank 34 in a mounted position in which the case 20 engages both the top surface 52 and the side surface 50 of the tank 34 at locations selected to prevent the case 20 from sliding off the tank 34 when a horizontal force F in any horizontal direction is applied to the tank 34 urging the case 20 to slide off the tank 34.

Preferably, the case 20 is configured to be brought into its mounted position by lowering the case 20 down onto the tank 34. The case 20 is configured to be removed from its mounted position by lifting the case 20 upward off of the tank 34. The case 20 and the tank 34 lack a securing device, such as a latch or fastener, for securing the case 20 to the tank 34. The case 20 has a tank-contacting surface 74 that has a rounded concave contour matching a rounded convex contour of the tank top surface 52 and that overlies the tank top surface 52 in the mounted position of the case 20. The case 20 further has a tank-contacting surface 76 that has a cylindrical contour matching the cylindrical contour of the tank side surface 50 and engages the tank side surface 50 in the mounted position of the case 20. The case 20 has a base 60 and a lid 62, connected together by a hinge 68, that together define a storage cavity. The case 20 holds items 22 that are used with the compressor 10.

This written description uses examples to disclose the invention, including best mode, and to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent structural elements with insubstantial differences from the literal language of the claims.

The invention claimed is:

1. An apparatus comprising:

a compressor including an air pump and a tank configured to store air compressed by the air pump, the compressor being configured to be used while in an operating position in which the tank is in an upright position and has a rounded top surface and a vertical cylindrical side surface extending downward from the periphery of the rounded top surface; and a storage case configured to be removably mounted on top of the tank in a mounted position in which the case rests on the tank's top surface and engages the tank's side surface at locations selected so as to prevent the case from sliding off the tank's rounded top surface when a horizontal force in any horizontal direction is applied to the case urging the case to slide off the tank;

wherein the apparatus lacks a latch or fastener for securing the case to the tank, for the prevention of the case slipping off the tank's rounded top surface to be due solely to the case's engagement of the tank's side surface, for the case to be brought into its mounted position by being simply lowered onto the tank and to be removed from its mounted position by being simply lifted upward from the tank without unlatching or unfastening.

2. The apparatus of claim 1 wherein said lowering is in the directly downward direction.

3. The apparatus of claim 1 wherein the case has a tank-contacting surface that has a rounded concave contour matching a rounded convex contour of the tank top surface and overlies the tank top surface in the mounted position of the case.

4. The apparatus of claim 1 wherein the case has an tank-contacting surface that has a cylindrical contour matching the cylindrical contour of the tank side surface and engages the tank side surface in the mounted position of the case.

5. The apparatus of claim 4 wherein the tank-contacting surface is configured to engage the tank side surface about over half the circumference of the tank.

6. The apparatus of claim 1 wherein the case has a base and a lid, connected together by a hinge, that together define a storage cavity.

7. The apparatus of claim 1 wherein the case holds items that are configured to be used with the compressor.

8. The apparatus of claim 1 wherein the compressor includes wheels and a handle, for wheeling the compressor over a floor by the handle.

9. The apparatus of claim 8 wherein the compressor includes a foot and is configured to be supported on the floor by the foot and the wheels, and is configured to be tilted to raise the foot above the floor in order to wheel the compressor across the floor.

10. An apparatus comprising:

a compressor including an air pump and a tank configured to store air compressed by the air pump, the compressor being configured to be used while in an operating position in which the tank is in an upright position and has a vertical cylindrical side surface and a rounded top surface above the side surface; and first and second storage cases, differing from each other in their internal configuration, each case configured to be removably mounted on top of the tank, in place of and interchangeably with the other case, in a mounted position in which the respective case engages the top surface and the side surface of the tank at locations selected so as to prevent the case from sliding off the tank when a horizontal force in any horizontal direction is applied to the case urging the case to slide off the tank.

11. The apparatus of claim 10 wherein outer shells of the first and second cases have a same outer appearance.

12. The apparatus of claim 10 wherein the tank's side surface extends downward from the periphery of the tank's rounded top surface.

13. The apparatus of claim 10 wherein the compressor includes wheels and a handle, for wheeling the compressor across a floor by the handle.

14. The apparatus of claim 13 wherein the compressor includes feet and is configured to be supported on the floor by the feet and the wheels, and is configured to be tilted to raise the feet above the floor in order to wheel the compressor across the floor.

15. An apparatus comprising:

a compressor including an air pump and a tank configured to store air compressed by the air pump, the compressor being configured to be used while in an operating position in which the tank is in an upright position and has a vertical cylindrical side surface and a rounded top surface above the side surface, the compressor including wheels, a foot and a handle and configured to be supported on a floor by the foot and the wheels and to be tilted to raise the foot above the floor in order to wheel the compressor across the floor by the handle; and first and second storage cases having the same outer appearance but differing from each other in their internal configuration, each case configured to be removably mounted on top of the tank, in place of and interchangeably with the other case, in a mounted position in which the respective case engages the top surface and the side surface of the tank at locations selected so as to prevent the case from sliding off the tank when a horizontal force in any horizontal direction is applied to the case urging the case to slide off the tank;

the apparatus lacking a latch or fastener for securing the case to the tank, such that the prevention of each case slipping off the tank's rounded top surface is due solely to the case's engagement with the tank's side surface, for the respective case to be brought into its mounted position by being simply lowered onto the tank and to be removed from its mounted position by being simply lifted upward from the tank without unlatching or unfastening.

* * * * *